US007306106B2

(12) United States Patent
Robertson

(10) Patent No.: US 7,306,106 B2
(45) Date of Patent: Dec. 11, 2007

(54) COOLER DOOR SHELF DEVICE WITH FLEXIBLE DISPLAY

(75) Inventor: James David Robertson, Atlanta, GA (US)

(73) Assignee: Display Industries, LLC, Norcross, GA (US)

( * ) Notice: Subject to any disclaimer, the term of this patent is extended or adjusted under 35 U.S.C. 154(b) by 269 days.

(21) Appl. No.: 11/196,014

(22) Filed: Aug. 3, 2005

(65) Prior Publication Data

US 2006/0102572 A1 May 18, 2006

Related U.S. Application Data

(63) Continuation-in-part of application No. 10/990,815, filed on Nov. 17, 2004.

(51) Int. Cl.
*A47B 73/00* (2006.01)

(52) U.S. Cl. ..... 211/75

(58) Field of Classification Search ..... 211/75, 211/85.4, 71.01, 72, 85.18, 87.01
See application file for complete search history.

(56) References Cited

U.S. PATENT DOCUMENTS

| | | | | |
|---|---|---|---|---|
| 4,560,072 | A | 12/1985 | Burrell | |
| 4,984,693 | A | 1/1991 | Belokin, Jr. et al. | |
| D316,790 | S | 5/1991 | Robbins et al. | |
| D323,766 | S | 2/1992 | Robbins et al. | |
| 5,096,272 | A * | 3/1992 | Belokin et al. | 312/129 |
| 5,330,261 | A | 7/1994 | Bennett | |
| 5,351,841 | A * | 10/1994 | Belokin et al. | 211/88.01 |
| D400,384 | S | 11/1998 | Belokin et al. | |
| D410,359 | S | 6/1999 | Belokin et al. | |
| 5,913,433 | A * | 6/1999 | Belokin et al. | 211/90.01 |
| D412,412 | S | 8/1999 | Lewis | |
| D413,036 | S | 8/1999 | Belokin et al. | |
| D413,473 | S | 9/1999 | Belokin et al. | |
| D413,474 | S | 9/1999 | Belokin et al. | |
| D429,436 | S | 8/2000 | Belokin et al. | |
| 6,571,967 | B2 | 6/2003 | Belokin et al. | |
| D488,017 | S | 4/2004 | Belokin et al. | |
| 2003/0080078 | A1 | 5/2003 | Belokin et al. | |
| 2003/0209505 | A1 | 11/2003 | Belokin et al. | |
| 2003/0222037 | A1 | 12/2003 | Belokin et al. | |
| 2004/0055981 | A1 | 3/2004 | Walsh et al. | |

* cited by examiner

*Primary Examiner*—Sarah Purol
(74) *Attorney, Agent, or Firm*—John L. James

(57) ABSTRACT

A shelf device for mounting on an inside surface of a cooler door comprises a bottom panel and left and right mounting flanges connected to the bottom panel along left and right side edge portions thereof. Each flange has a pair of openings therein vertically spaced from one another and adapted to mount and support the shelf device. A partition panel is connected to the bottom panel and divides the bottom panel into a plurality of compartments. Vertically extending ribs are attached to the partition panel at junctions of adjacent compartments. A display panel insert is received by slots in the ribs and recesses in the mounting flanges.

6 Claims, 2 Drawing Sheets

COOLER DOOR SHELF DEVICE WITH FLEXIBLE DISPLAY

CROSS REFERENCE TO RELATED APPLICATIONS

This application is a continuation in part of application Ser. No. 10/990,815 filed Nov. 17, 2004, entitled "cooler Door Shelf Device" and is related to commonly assigned co-pending application Ser. No. 10/929,975 filed Aug. 20, 2004 entitled "Cooler Door Shelf Device With Removable Product Panel"; Ser. No. 10/944,246, filed Sep. 16, 2004 entitled "Cooler Door Shelf Device With Stick-On Display Panels"; Ser. No. 10/944,295, filed Sep. 16, 2004 entitled "Cooler Door Shelf Device With Raised Panels"; Ser. No. 10/947,467, filed Sep. 22, 2004, entitled "Neck-Hanging Cooler Door Shelf Device"; and Ser. No. 10/947,472, filed Sep. 22, 2004, entitled "Vented Cooler Door Shelf Device".

TECHNICAL FIELD OF THE INVENTION

This invention relates generally to a cooler, and, more particularly, to a door shelf device for a transparent cooler door.

BACKGROUND OF THE INVENTION

Upright coolers in supermarkets and convenience stores typically have transparent glass doors so that the products inside are visible. It is now common to use the inside of the door for shelving as is done in household refrigerators. Door shelving fits against the door so that the product containers are visible, however the product labels do not always face forward for easy identification of the product. Some shelves have a small area for affixing product identification, but such small areas lack the impact needed, especially for impulse purchases. Accordingly, it will be appreciated that it would be highly desirable to have a door shelf with a large area for product labeling and identification.

A display shelf which employs a mounting or support panel for attachment to one face of a transparent wall is disclosed in U.S. Pat. No. 5,913,433. The display shelf has a floor which projects from the top edge of the support panel and a containment wall which projects upwardly from the floor. The support panel does not extend above the floor in the area which supports displayed product so that the product is visible through the transparent wall. Advertising material may be displayed on the support panel below the floor, and the containment wall and/or floor may be appropriately shaped to provide individual compartments for each unit of product displayed. The display shelf is supported on a cooler door by suction cups which anchor in openings in flanges wherein one opening is above the floor and the other opening is below the floor. Advertising on the support panel cannot be changed while the shelf is attached to the cooler door because the lower openings and suction cups block access. Accordingly, it will be appreciated that it would be highly desirable to have a display shelf device that allows the advertising to be changed while the shelf device is attached to the cooler door.

SUMMARY OF THE INVENTION

The present invention is directed to overcoming one or more of the problems set forth above. Briefly summarized, according to the present invention, a shelf device for a vertical surface of a cooler door comprises a bottom panel having front, rear, left and right side edge portions. A left mounting flange is connected to the bottom panel along the left side edge portion and extends upward therefrom. The left mounting flange defines a left recess. A right mounting flange is connected to the bottom panel along the right side edge portion and extends upward therefrom. The right mounting flange defines a right recess. An upstanding partition panel is connected to the bottom panel and the left and right mounting flanges forming a plurality of compartments along the bottom panel. A plurality of vertically extending ribs are formed at junctions of the compartments with each rib defining a slot. A display panel insert is received in the slots of the ribs and extends laterally toward the left and right recesses of the mounting flanges.

The shelf device utilizes space in the cooler that would otherwise be wasted. The shelf device increases visual appeal and places product identification at the door where it is more readily seen than that on the containers further back in the cooler. The display panel insert is slidably received by the slots in the ribs with ends of the insert disposed in the recesses of the flanges. Because the shelf device is supported via openings in the flanges above and below the display panel and is spaced from the door by suction cups, the insert can be inserted and removed while the shelf device is mounted on the cooler door. The recesses allow the display panel to be inserted and removed but retains the insert against inadvertent removal.

A partition panel is connected to the bottom panel and both mounting flanges dividing the bottom panel into a plurality of compartments. A plurality of vertically extending ribs are attached to the partition panel at junctions of adjacent compartments. A display panel is spaced from the bottom panel and attached to the ribs and extends laterally between the flanges.

The slots and recesses allow the display panel insert to fit flush with the mounting flanges. Positioning the display panel above the bottom panel creates a space for improved air circulation. Ventilation openings also promote increased air flow.

These and other aspects, objects, features and advantages of the present invention will be more clearly understood and appreciated from a review of the following detailed description of the preferred embodiments and appended claims, and by reference to the accompanying drawings wherein similar reference numerals have been used, where possible, to designate similar or identical features that are common to the figures.

DETAILED DESCRIPTION OF THE PREFERRED EMBODIMENTS

Figure 1:
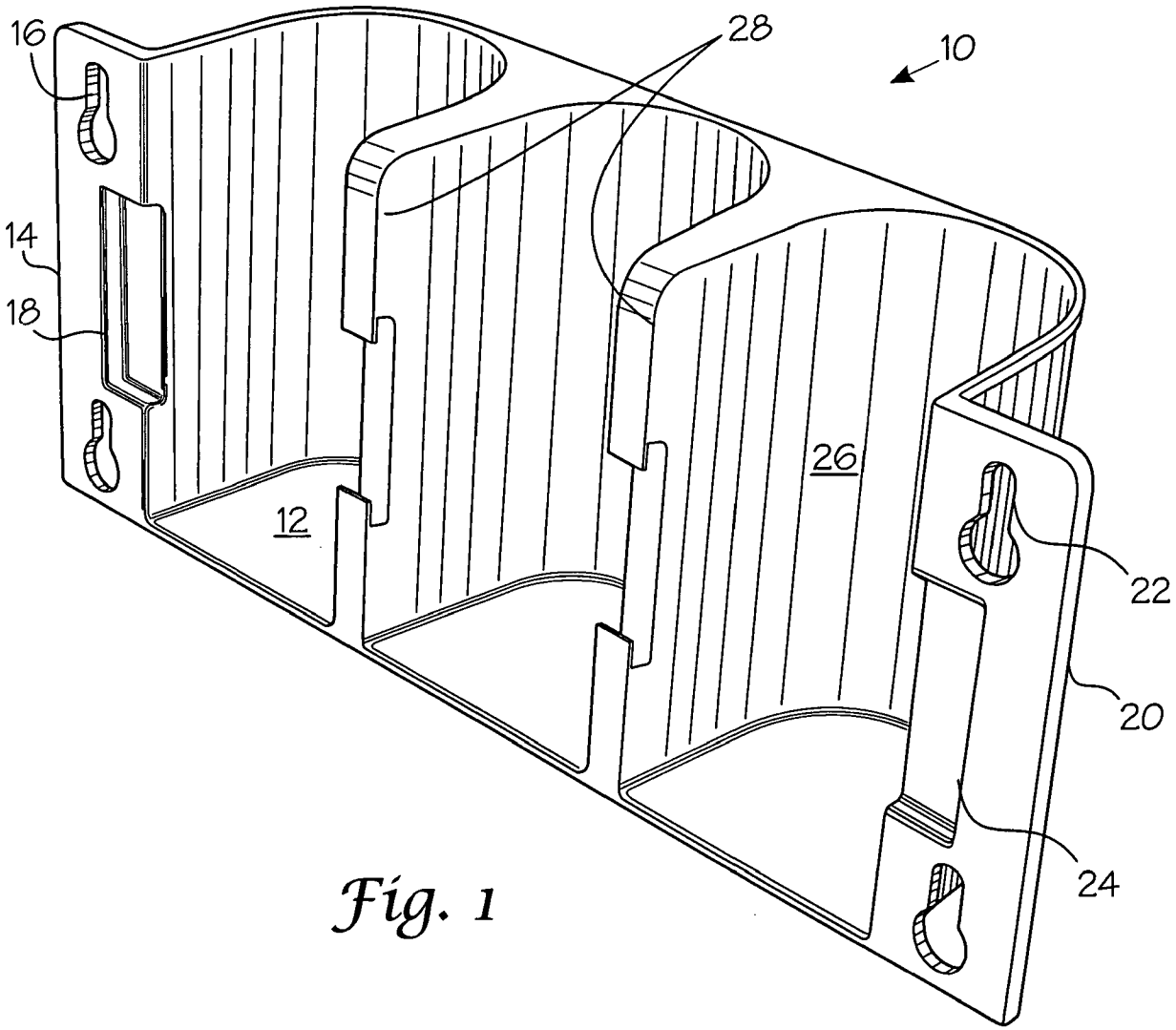
FIG. 1 is a front perspective view of a preferred embodiment of a shelf device for attaching to the inside surface of an upright cooler door according to the present invention.
Figure 3:
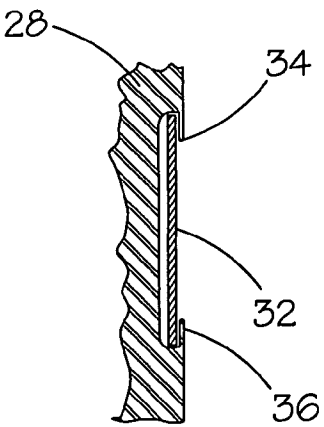
FIG. 3 is a fragmentary side view of a supporting rib of the shelf device of FIG. 1 illustrating retaining flanges for a display panel insert.
Figure 2:
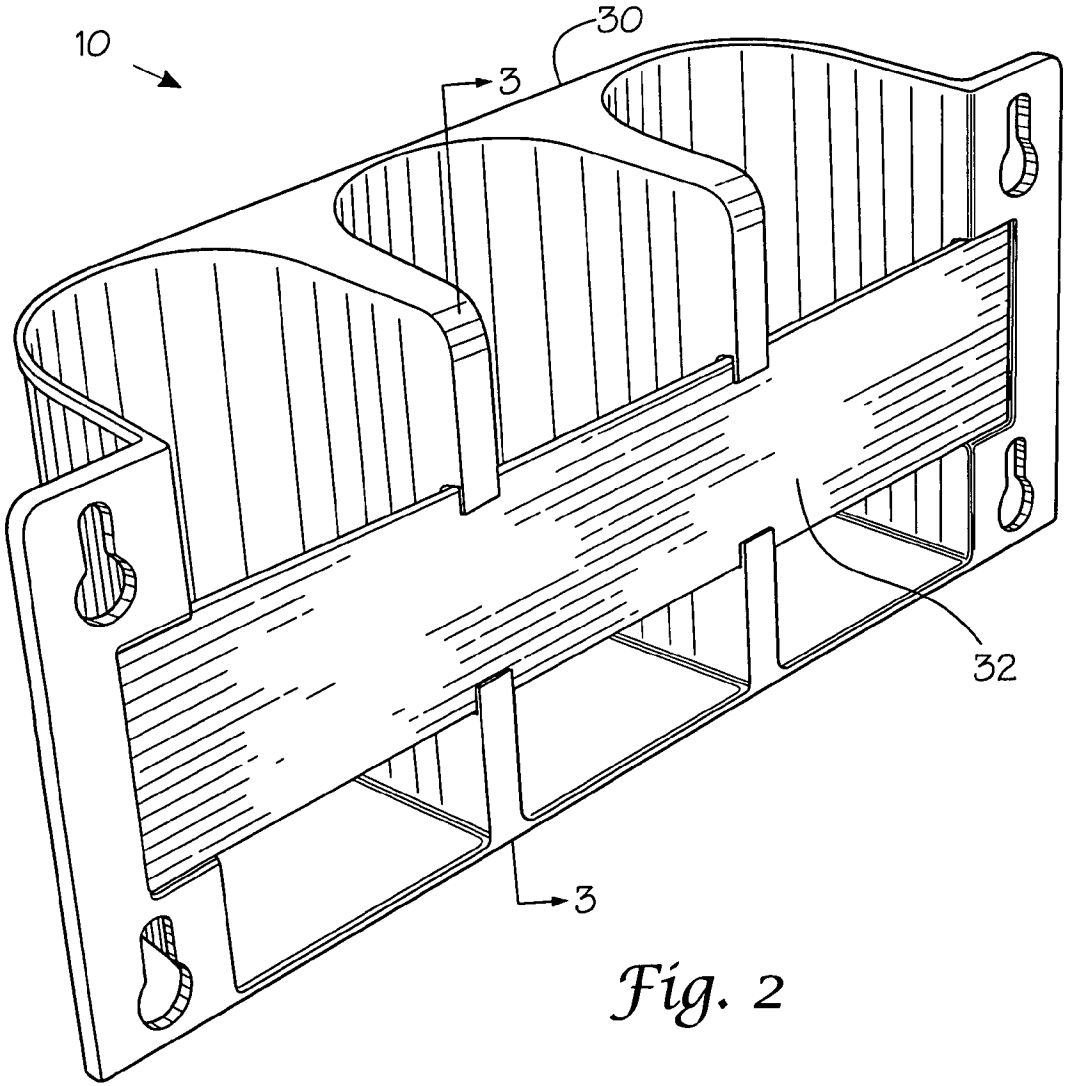
FIG. 2 is a front perspective view of the shelf device of FIG. 1 with a display panel insert attached.

Referring to FIGS. 1-3, a shelf device 10 is provided for attaching to an inside surface of an upright cooler door. Articles, such as beverage containers for example, can be placed on shelf device 10 for easy viewing through the cooler door which minimizes the need to open the door to view the contents. It also utilizes the door space for storing additional product in a space that may otherwise be wasted. Product on the shelf device always remains up front within the easy view and grasp of a consumer.

Shelf device 10 has a bottom panel 12 with front, rear, left and right side edge portions. A left mounting flange 14 is connected to bottom panel 12 along the front and left side edge portions and extends upward therefrom. Upstanding left mounting flange 14 preferably has a pair of slotted openings or keyways 16 therein vertically spaced from one another and adapted to mount and support the shelf device in conjunction with suction cups or the like. Left flange 14 has a slot or recess 18 preferably positioned between the keyways 16 above bottom panel 12, but which can be located at any point along left flange 14.

Similarly, a right mounting flange 20 is connected to bottom panel 12 along the front and right side edge portions and extends upward therefrom. Upstanding right mounting flange 20 preferably has a pair of slotted openings or keyways 22 therein vertically spaced from one another and adapted to mount and support the shelf device in conjunction with suction cups or the like. While suction cups are preferred, an adhesive or other connecting or attaching means may be used where the shelf device is to be installed and there is no need to change the display panel insert 32. Right flange 20 has a slot or recess 24 preferably positioned between the keyways 22 above bottom panel 12, but which can be disposed at any point along right flange 20. Preferably, the front faces of the mounting flanges are flush with the front edge of bottom panel 14. The recesses 18, 24 of mounting flanges 14, 20 may contain bores for accepting screws, adhesive or other fasteners. Alternatively, the bores may be omitted and an adhesive used as a fastener.

A partition panel 26 is connected to bottom panel 12 and the left and right mounting flanges 14, 20 dividing bottom panel 12 into a plurality of compartments. Panel 26 extends upward from bottom panel 12. As illustrated, the compartments are curved to fit the contour of beverage bottles, but can be contoured to fit other container shapes. Preferably, a bridging member 30 spans the spaces at the top between the outside curves of the compartments. Also, where desired, bottom panel 12 can extend between similar spaces at the bottom of the outside curves of the compartments.

A supporting rib 28 is formed at the junction of adjacent segments of partition panel 24 and is preferably flush with the front edge of bottom panel 12.

A flexible display panel insert 32 is seated in the left and right mounting flanges 14, 20 in their respective recesses 18, 24. Display panel insert 32 is spaced from bottom panel 12 and is not required to contribute to the support of the shelf device 10. The spacing improves air circulation. Each rib 28 has top and bottom flanges, protrusions or lips 34, 36 forming a slot for slidably receiving a display panel insert 38. Each lip or protrusion may be a single lip or may be a series of shorter lips extending laterally across display panel 32. A single lip provides a continuous profile for aesthetic appeal. The lips prevent the insert from falling forward toward the cooler door. While the display panel insert is flexible, it does not have to flex to provide a vertical force fit because the lips retain the display panel insert in the slots. Flange recesses do not extend across the entire faces of the flanges to retain display panel insert in the slot behind the lips.

Partition panel 26 is connected to bottom panel 12 and the left and right mounting flanges 14, 20 dividing bottom panel 12 into a plurality of compartments. Panel 26 extends upward from bottom panel 12. The front edge of bottom panel 12 is flush with the left and right ends of partition panel 26 and flush with the front faces of left and right flanges 14, 20. As illustrated, the compartments are curved to fit the contour of beverage cans or bottles, but can be contoured to fit other container configurations. A bridging member 30 spans spaces at the top between the outside curves of the compartments giving a more finished appearance and increasing structural integrity. Also, where desired, bottom panel 12 can extend between similar spaces at the bottom of the outside curves of the compartments.

While the invention has been described with particular reference to the preferred embodiments, it will be understood by those skilled in the art that various changes may be made and equivalents may be substituted for elements of the preferred embodiments without departing from invention. For example, a display shelf device with three compartments for holding three beverage containers has been illustrated, but any number of compartments can be formed to fit the width of the cooler door. It is accordingly intended that the claims shall cover all such modifications and applications as do not depart from the true spirit and scope of the invention.

ELEMENT LIST

10 shelf device
12 bottom panel
14 left mounting flange
16 left keyways
18 left flange recess
20 right mounting flange
22 right keyways
24 right flange recess
26 partition panel
28 supporting ribs
30 bridging member
32 display panel insert
34 top flange or lip
36 bottom flange or lip

What is claimed is:

1. A display shelf device for a vertical surface of a cooler door, comprising:

a bottom panel having front, rear, left and right side edge portions;

a left mounting flange connected to said bottom panel along said left side edge portion and extending upward therefrom, said left flange defining a left recess;

a right mounting flange connected to said bottom panel along said right side edge portion and extending upward therefrom, said right flange defining a right recess;

an upstanding partition panel connected to said bottom panel and said left and right mounting flanges forming a plurality of compartments along said bottom panel;

a plurality of vertically extending ribs formed at junctions of adjacent compartments with each rib defining a vertical slot spaced from said bottom panel; and a display panel insert positioned in said vertical slots of said ribs above said bottom panel and extending laterally toward said left and right recesses of said mounting flanges.

2. A shelf device, as set forth in claim 1, wherein each of said slots has top and bottom flanges slidably retaining said display panel insert.

3. A shelf device, as set forth in claim 1, wherein ends of said display panel insert rest in said recesses of said left and right flanges.

4. A shelf device, as set forth in claim 1, wherein said ribs are flush with said front edge portion of said bottom panel.

5. A shelf device, as set forth in claim 1, wherein said left mounting flange is connected to said bottom panel along said left side edge portion and extends upward therefrom, said left mounting flange having a pair of left keyways therein vertically spaced from one another and adapted to mount and support said shelf device.

6. A shelf device, as set forth in claim 1, wherein said right mounting flange is connected to said bottom panel along said right side edge portion and extends upward therefrom, said right mounting flange having a pair of right keyways therein vertically spaced from one another and adapted to mount and support said shelf device.

* * * * *